US005220820A

United States Patent [19]

Terrell et al.

[11] Patent Number: 5,220,820

[45] Date of Patent: Jun. 22, 1993

[54] APPARATUS AND METHOD FOR CUSHIONING MOVEMENT OF A MEMBER IN A PRESS

[75] Inventors: John B. Terrell, Chardon, Ohio; Michael B. Budai, Hendersonville, Tenn.

[73] Assignee: Teledyne Industries Inc., Cleveland, Ohio

[21] Appl. No.: 780,127

[22] Filed: Oct. 21, 1991

[51] Int. Cl.[5] ..... B21D 24/02

[52] U.S. Cl. ..... 72/453.13; 267/122; 267/119; 267/130

[58] Field of Search ..... 72/453.13; 267/119, 267/122, 130, 64.23

[56] References Cited

U.S. PATENT DOCUMENTS

| | | | |
|---|---|---|---|
| 2,662,478 | 12/1953 | Surre . | |
| 3,157,095 | 11/1964 | Heiser . | |
| 3,202,411 | 8/1965 | Heiser . | |
| 3,457,765 | 7/1969 | Heiser . | |
| 3,551,491 | 5/1970 | Kraft . | |
| 3,636,749 | 1/1972 | Heiser | 72/351 |
| 3,969,991 | 7/1976 | Comstock et al. | 92/99 |
| 4,076,103 | 2/1978 | Wallis | 267/119 |
| 4,257,254 | 3/1981 | Adamus et al. | 72/432 |
| 4,688,775 | 8/1987 | Kadis | 267/119 |
| 4,691,902 | 9/1987 | Kadis | 267/119 |
| 4,765,227 | 8/1988 | Balazs et al. | 91/417 R |
| 4,815,718 | 3/1989 | Kadis | 267/119 |
| 5,007,276 | 4/1991 | Kadis . | |
| 5,027,637 | 7/1991 | Umetsu | 267/119 |
| 5,098,071 | 3/1992 | Umetsu | 267/64.27 |

FOREIGN PATENT DOCUMENTS 0268036 9/1987 European Pat. Off. .

OTHER PUBLICATIONS

Publication by Teledyne Hyson entitled "The Tanker" and having a a copyright date of 1987.

Publication by Bellofram Corporation and having a 1988 copyright date.

*Primary Examiner*—David Jones

*Attorney, Agent, or Firm*—Tarolli, Sundheim & Covell

[57] ABSTRACT

An apparatus and method for use in cushioning movement of a member in a press includes a cushion assembly having a piston and cylinder which are movable relative to each other against the influence of fluid pressure to cushion movement of the member. A flexible diaphragm retains a body of lubricant between an inner side of the diaphragm and the piston. The body of lubricant lubricates a seal between the piston and the cylinder. Fluid pressure is applied against the outer side of the diaphragm to oppose movement of the piston during operation of the press from the open condition to the closed condition. The piston is movable relative to the cylinder, under the influence of the fluid pressure applied against the outer side of the diaphragm and transmitted to the piston, during operation of the press from the closed condition to the open condition. The piston and diaphragm are spaced apart with the body of lubricant filling the space between the piston and diaphragm.

51 Claims, 2 Drawing Sheets

APPARATUS AND METHOD FOR CUSHIONING MOVEMENT OF A MEMBER IN A PRESS

BACKGROUND OF THE INVENTION

The present invention relates to a new and improved apparatus and method for use in cushioning movement of a member in a press during operation of the press between open and closed conditions.

A piston and cylinder have previously been used in a cushion assembly to cushion movement of a member during operation of a press between open and closed conditions. In order to maximize the operating life of the cushion assembly, it is necessary to maintain seals between the piston and cylinder lubricated during operation of the cushion assembly. It has previously been suggested that th seals between the piston and cylinder in a press cushion assembly be lubricated in any one of many different ways, including those disclosed in U.S. Pat. Nos. 4,076,103; 4,688,775; 4,691,902 and 4,815,718.

Although known seal lubrication arrangements used in press cushion assemblies have been more or less successful, difficulty has been encountered in lubricating the seals in certain press cushion assemblies. For example, difficulty has been encountered in lubricating seals in press cushion assemblies having a relatively short stroke, that is a stroke of 0.50 inches or less, and operated at a relatively high rate, that is at a rate of 100 cycles per minute or more. Thus, it is desired to operate one known press at a rate of more than 100 cycles per minute around the clock, that is for twenty-four hours a day and seven days a week. The cushion assemblies in this known press have a stroke of less than 0.50 inches. When this particular press is operated in this manner, the cushion assemblies are replaced after a million cycles or approximately one week of use.

It is believed that a cushion assembly in the press described above fails as a result of a lack of lubrication of the seals between the piston and cylinder in the cushion assembly. Thus, the cushion assembly piston moves so rapidly and through such a short stroke that it is difficult to maintain the seals lubricated during use of the press.

SUMMARY OF THE INVENTION

The present invention relates to a new and improved apparatus and method for use in cushioning movement of a member in a press during operation of the press between open and closed conditions. Although the apparatus and method may advantageously be used on many different types of presses, it is believed that the apparatus and method will be particularly useful when used in association with a cushion assembly having a piston and cylinder which is operated through relatively short strokes at relatively high speed. Thus, it is believed that the apparatus and method of the present invention will be particularly advantageous when used in association with a press cushion assembly which is operated at a rate of at least 100 cycles per minute through cushioning and return strokes of 0.50 inches or less during each operating cycle. This is because the present invention maintains seals in the cushion assembly lubricated during operation of the press. Of course, the apparatus and method of the present invention may also be used to lubricate the seals in cushion assemblies which are operated at slower speeds through longer strokes.

The apparatus and method of the present invention retains a body of lubricant between an inner side of a diaphragm and a piston in a cushion assembly used to cushion movement of a member in a press. Fluid pressure is applied against an outer side of the diaphragm and is transmitted to the piston in the cushion assembly.

During operation of the press from an open condition to a closed condition, the piston is moved against the influence of the fluid pressure applied against the diaphragm to cushion movement of a member in the press. During operation of the press from the closed condition to the open condition, the fluid pressure applied against the diaphragm moves the piston back to its initial position relative to the cylinder During this movement of the piston, seals between the piston and cylinder are continuously lubricated by lubricant from the body of lubricant disposed between the piston and diaphragm.

During operation of the press between the open and closed conditions, the diaphragm is advantageously maintained in a spaced apart relationship with the piston. The space between the diaphragm and piston is filled by the body of lubricant Therefore, the fluid pressure applied against the outer side of the diaphragm is transmitted through the body of lubricant to the piston. By maintaining the spaced apart relationship between the diaphragm and piston, diaphragm wear tends to be minimized and the operating life of the cushion assembly tends to be maximized.

Accordingly, it is an object of this invention to provide a new and improved method and apparatus for cushioning movement of a member in a press during operation of the press between open and closed conditions and wherein a cushion assembly includes a body of lubricant which is retained between a piston and a diaphragm against which fluid pressure is applied.

Another object of this invention is to provide a new and improved method and apparatus as set forth in the preceding object and wherein the press is operated at a rate of at least 100 cycles per minute and the piston and cylinder are moved relative to each other through cushioning and return strokes of 0.50 inches or less during each operating cycle of the press.

Another object of the present invention is to provide a new and improved method and apparatus as set forth in either one of the preceding objects and wherein pressure is transmitted from the diaphragm through the body of lubricant to the piston to urge the piston toward an initial position relative to the cylinder.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
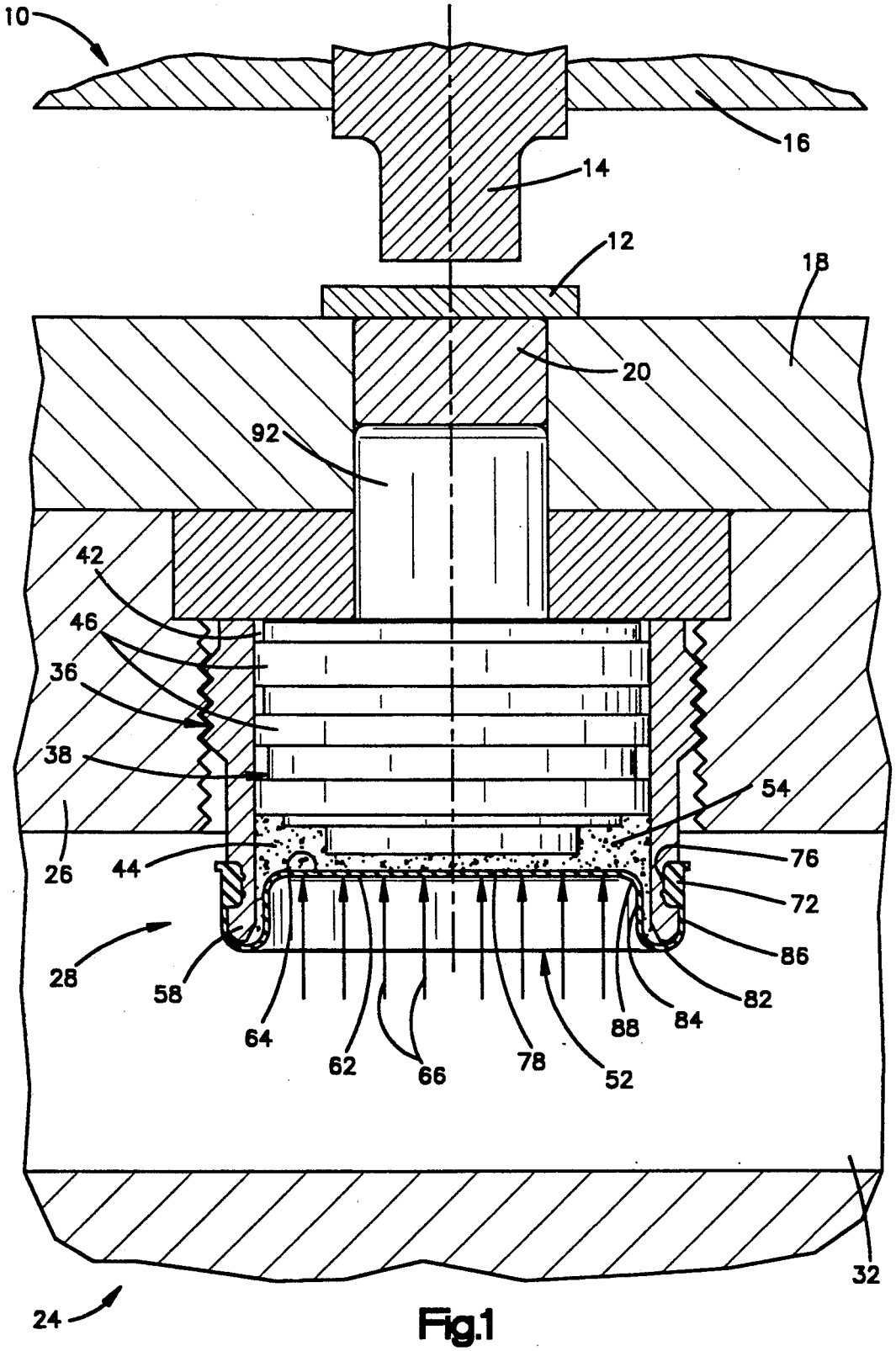
FIG. 1 is a schematic illustration of a portion of a press having a cushion assembly which is constructed and operated in accordance with the present invention, the press being shown in an open condition and the cushion assembly being shown in an extended condition.

A press 10 is illustrated schematically in FIG. 1 in an open condition prior to forming of a metal workpiece 12. The press 10 includes a punch or upper die member 14 which is mounted on an upper die shoe 16. The workpiece 12 is supported on a lower die member 18 and a pressure pad 20.

The press 10 is operated at a relatively high rate, that is at a rate of 100 cycles per minute or more. Although the punch 14 and upper die shoe 16 are moved through a greater distance relative to the lower die member 18, deformation of the workpiece 12 by the punch 14 occurs during only 0.50 inches or less of movement of the punch 14. This enables the press 10 to be used to quickly impart relatively small deformations to workpieces 12. In one specific instance, the workpieces 12 were shaped to form beverage can lids.

A manifold assembly 24 includes a manifold plate 26 and a cushion assembly 28. The cushion assembly 28 is constructed and operated in accordance with the present invention to cushion movement of the workpiece 12, punch 14 and pressure pad 20 during operation of the press 10 from the open condition of FIG. 1 to the closed condition of FIG. 2. The manifold assembly 24 has a chamber 32 which holds fluid, that is nitrogen ($N_2$) gas, at a pressure of approximately 1,500 pounds per square inch. The fluid pressure in the manifold chamber 32 is effective to continuously urge the cushion assembly 28 toward the extended or initial condition of FIG. 1.

The cushion assembly 28 includes a cylinder 36 which is fixedly connected with the manifold plate 26. A cylindrical piston 38 is reciprocatable within the cylinder 36. The piston 38 divides the cylinder into a variable volume head end chamber 42 and a variable volume rod end chamber 44. Annular seals 46 are provided between the piston 38 and the cylinder 36 to block fluid flow between the head and rod end variable volume chambers 42 and 44 in a known manner.

Figure 2:
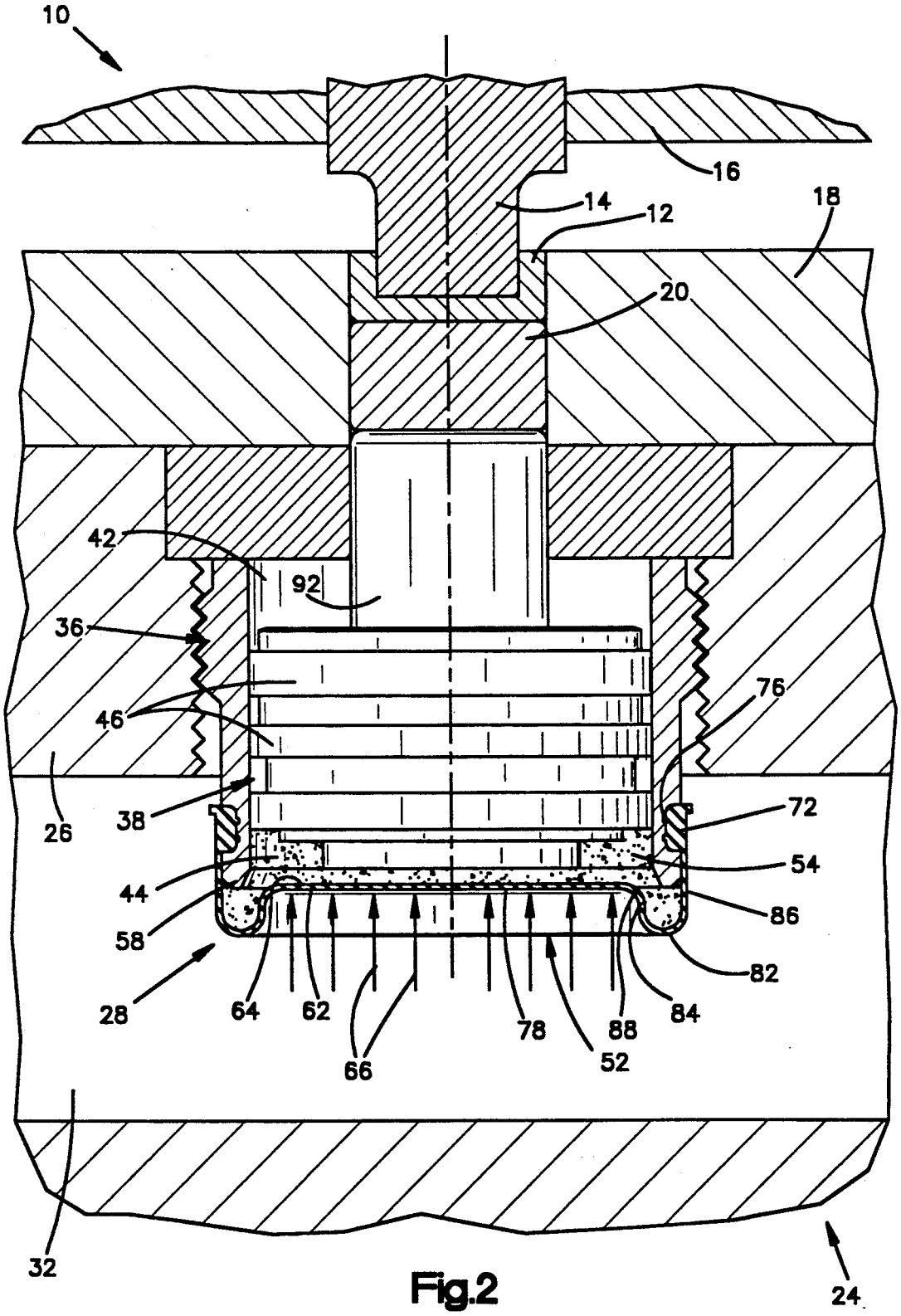
FIG. 2 is a schematic illustration, generally similar to FIG. 1, illustrating the press in a closed condition and the cushion assembly in a retracted condition.

During operation of the press 10 from the open condition of FIG. 1 to the closed condition of FIG. 2, the workpiece 12 is formed to have a desired configuration. During operation of the press 10 between the open and closed conditions, the cushion assembly 28 cushions movement of the workpiece 12, punch 14 and pressure pad 20. However, it is contemplated that the cushion assembly 28 could be used to cushion movement of any one of many different members in many different types of presses. For example, the cushion assembly 28 could be used to cushion movement of a member in the manner described in U.S. Pat. Nos. 3,157,095; 3,202,411; 3,457,765; 3,636,749; 4,257 254; 4,765,227 and 5,007,276. It is contemplated that the cushion assembly 28 will be used in presses which form many different types of workpieces 12.

In accordance with a feature of the present invention, a flexible diaphragm 52 retains a body 54 of lubricant in the cylinder 36 during operation of the press 10 between the open and closed conditions of FIGS. 1 and 2. The body 54 of lubricant lubricates the seals 46 to extend the operating life of the cushion assembly 28. In addition, the body 54 of lubricant transmits pressure between the diaphragm 52 and piston 38. The body 54 of lubricant completely fills the space between the diaphragm 52 and the head end of the piston 38.

Although it is believed that the cushion assembly 28 may be used in many different types of presses, it is projected that the cushion assembly 28 will find its most extensive use in presses which are operated at a relatively high rate, that is at a rate of at least 100 cycles per minute. It is also projected that the cushion assembly 28 will be extensively used in situations in which the cushion assembly must have a relatively short operating stroke, that is an operating stroke of 0.50 inches or less. This is because it has been found to be particularly difficult to lubricate the seals 46 in a cushion assembly which is operated at a high rate with a short operating stroke. Of course, a cushion assembly having the same general construction as the cushion assembly 28 may be adapted to have a long operating stroke and be used in a press having a relatively slow operating rate if desired.

The circular flexible diaphragm 52 extends across an end portion 58 of the cylinder 36. An outer side surface 62 of the diaphragm 52 is exposed to the fluid (gas) pressure in the manifold chamber 32. An inner side surface 64 of the flexible diaphragm 52 is exposed to the fluid (liquid) pressure in the body 54 of lubricant. The body 54 of lubricant completely fills the space between the inner side surface 64 of the flexible diaphragm and the cylinder 36 and piston 38. The nitrogen gas pressure presses the inner side surface 64 of the diaphragm upwardly (as viewed in FIGS. 1 and 2) against the synthetic oil of the continuous body 54 of lubricant in the manner indicated schematically by arrows 66.

Due to the flexible characteristics of the diaphragm 52, the liquid body 54 of lubricant at the head end chamber 44 is maintained at substantially the same pressure as the gas in the manifold chamber 32, that is at a pressure of approximately 1,500 pounds per square inch. Of course, the manifold chamber 32 could hold gas at a different pressure if desired. The rod end variable volume chamber 42 is exhausted to atmosphere through a pressure relief type check valve (not shown) which is effective to maintain the fluid pressure in the rod end chamber at a pressure which is only slightly greater or below atmospheric pressure. Thus, when the press 10 is in the open condition of FIG. 1, the rod end variable volume chamber 42 will probably be at a fluid pressure which is approximately equal to atmospheric pressure.

When the press 10 is operated to the closed condition of FIG. 2, expansion of the rod end variable volume chamber 42 will result in the fluid pressure in the rod end chamber being substantially less than atmospheric pressure. Due to the pressure differential between the rod and head end variable volume chambers 42 and 44, the lubricant from the body 54 of lubricant will tend to gradually seep from the head end variable volume chamber 44 toward the rod end variable volume chamber 42 during extended operation of the press 10. This results in the seals 46 being maintained in a lubricated condition even though the piston 38 may move through a very short stroke relative to the cylinder 36.

The one-piece diaphragm 52 is formed of a fluid impervious flexible material In one specific embodiment of the invention, the diaphragm 52 was formed as a single layer of Dacron (polyester) fabric coated with Nitrile (elastomer). The diaphragm 52 is impervious to both the gas in the manifold chamber 32 and the synthetic oil forming the body 54 of lubricant. In this specific embodiment of the diaphragm 52, the Dacron fabric formed the outer side surface 62 of the diaphragm while the Nitrile formed the inner side surface 64 of the diaphragm. This particular embodiment of the diaphragm 52 was obtained from Precision Industries Corporation of 4565 North Street, Butler, Wis., USA. It should be understood that it is contemplated that the diaphragm 52 could be formed of materials other than these specific materials.

The space between the head end of the piston 38 and the inner side surface 64 of the diaphragm 52 is completely filled by the body 54 of lubricant. The diaphragm 52 has an annular mounting portion 72 which sealingly grips an annular groove 76 formed in the outside of the cylinder 36 to prevent leakage of lubricant. It is contemplated that a band could be provided around the outside of the mounting portion 72 of the diaphragm 52 to mechanically clamp the mounting portion 72 of the diaphragm in the cylinder groove 76.

A flat circular central portion 78 of the diaphragm is disposed in a coaxial relationship with the piston 38 and extends across the majority of the area of the head end portion of the piston. A flexible and axially movable annular roll portion 82 of the diaphragm 52 has a continuously curving configuration and is coaxial with the cylinder 36 and the central portion 78 of the diaphragm. The roll portion 82 of the diaphragm 52 interconnects a variable length cylindrical inner side wall 84 of the flexible diaphragm and a variable length cylindrical outer side wall 86 of the diaphragm. The central portion 78, roll portion 82, and side walls 84 and 86 are all formed as a single continuous layer which is free of stress inducing discontinuities, such as corners where two or more surfaces intersect. Thus, the central portion 78 of the diaphragm 52 is connected with the side wall 84 by an annular connector section 88 which is continuously curving in both radial and circumferential directions.

The cylindrical inner wall 84 of the diaphragm connects the central portion 78 of the diaphragm with the roll portion 82. The cylindrical outer wall 86 of the diaphragm interconnects the annular mounting portion 72 and the roll portion 82. The cylindrical inner and outer walls 84 and 86 are disposed in a coaxial relationship with the central and roll portions 78 and 82 of the diaphragm 52.

The roll portion 82 has an annular configuration with a semi-circular radial cross section. The roll portion 82 is movable along the flexible material of the diaphragm 52 with a smooth and discontinuity free rolling action during operation of the press 10 between the open and closed conditions. When the press 10 is in the open condition of FIG. 1, the lower end portion 58 of the cylinder 36 extends into the roll portion 82. When the press 10 is in the closed condition of FIG. 2, the roll portion 82 has moved downwardly in the flexible material of the diaphragm 52 so that the lower end portion 58 of the cylinder 36 is above the roll portion.

When the press 10 is in the open condition of FIG. 1, the circular central portion 78 of the diaphragm is disposed within the cylinder 36. At this time, the cylindrical inner wall 84 of the diaphragm is axially longer than the cylindrical outer wall 86 of the diaphragm. The cylindrical inner and outer walls 84 and 86 of the diaphragm are disposed in a coaxial relationship with each other and the cylinder 36.

As the press 10 is operated from the open condition of FIG. 1 toward the closed condition of FIG. 2, the punch 14 is pressed downwardly against the workpiece 12 by the upper die shoe 16 to form the workpiece in the lower die member 18. As this occurs, force is transmitted from the pressure pad 20 to the piston 38 by the cylindrical piston rod 92. Downward movement of the piston rod 92 forces the piston 38 downwardly.

As the piston 38 moves downwardly, the body 54 of lubricant is pressed downwardly against the inner side surface 64 of the diaphragm 52. This forces the central portion 78 of the diaphragm 52 to move downwardly to a position in which it is almost outside of the cylinder 3 (FIG. 2). Downward movement of the piston 38 and central portion 78 of the diaphragm 52 is opposed by the pressure of the gas in the manifold chamber 32. During downward movement of the piston 38 and central portion 78 of the diaphragm 52 the distance between the head end of the piston and the central portion of the diaphragm remains constant.

The fluid pressure applied against the diaphragm 52 by the gas in the manifold chamber 32 is transmitted through the body 54 of lubricant to the piston 38. The pressure force applied against the piston 38 by the body 54 of lubricant cushions movement of the workpiece 12, punch 14, and pressure pad 20 as the press is operated to the closed condition.

As the piston 38 moves downwardly, a downward (as viewed in FIGS. 1 and 2) rolling action occurs at the roll portion 82 of the diaphragm 52. This downward rolling action results in a smooth, almost frictionless movement of the roll portion 82 of the diaphragm 52 downwardly away from the end portion 58 of the cylinder 36 against the fluid pressure in the manifold chamber 32. As the roll portion 82 of the diaphragm 52 moves downwardly, the axial extent of the cylindrical inner wall 84 decreases and the axial extent of the cylindrical outer wall 86 of the diaphragm increases.

The volume of the body 54 of lubricant and the volume of the chamber formed between the diaphragm 52 and the head end of the piston 38 remain constant as the press 10 is operated from the open condition to the closed condition. The body 54 of lubricant completely fills the chamber formed between the diaphragm and the head end of the piston 38. However, the chamber in which the body 54 of lubricant is contained expands axially downwardly (as viewed in FIG. 2) from the end portion 58 of the cylinder 36 into the manifold chamber 32 while the piston 38 moves downwardly inside the cylinder.

The cross sectional area of the outside of the cylinder 36 in a plane perpendicular to the central axis of the cylinder is greater than the cross sectional area of the piston 38 and inside of the cylinder in the same plane. For each increment of axial movement of the piston 38, the portion of the lubricant containing chamber between the end 58 of the cylinder and the roll portion 82 of the diaphragm 52 expands to accommodate lubricant displaced by movement of the piston. Therefore, the piston 38 moves downwardly through a greater distance than the roll portion 82 of the diaphragm 52 even through the distance between the central portion 78 of the diaphragm and the piston 38 remains constant.

As the press 10 is operated from the closed condition of FIG. 2 back to the open condition of FIG. 1, the fluid pressure applied against the outer side surface 62 of the diaphragm 52 is transmitted to the body 54 of lubricant. The fluid pressure in the body 54 of lubricant moves the piston 38 upwardly to the extended position shown in FIG. 1. This upward movement of the piston 38 will result in the formed workpiece 12 being ejected from the lower die member 18 by the pressure pad 20.

As the piston 38 moves upwardly, an upward (as viewed in FIGS. 1 and 2) rolling action occurs at the roll portion 82 of the diaphragm 52. This upward rolling action results in a smooth, almost frictionless movement of the roll portion 82 of the diaphragm 52 upwardly toward the end portion 58 of the cylinder 52 under the influence of the fluid pressure in the manifold chamber 32. As the roll portion 82 of the diaphragm 52 moves upwardly, the axial extent of the cylindrical inner wall 84 increases and the axial extent of the cylindrical outer wall 86 of the diaphragm decreases.

During operation of the press 10, the diaphragm 52 is continuously maintained in a spaced apart relationship with the piston 38. This tends to minimize wear of the diaphragm 52. The space between the diaphragm 52 and the piston 38 is, at all times, completely filled by the body 54 of lubricant. Therefore, the fluid pressure in the manifold chamber 32 is transmitted from the diaphragm to the body 54 of lubricant. The resulting pressure in the body 54 of lubricant is transmitted to the piston 38 to urge the piston upwardly from the lower end-of-stroke position shown in FIG. 2 to the upper end-of-stroke position shown in FIG. 1.

Although the cushion assembly 28 has been shown in FIGS. 1 and 2 with the piston rod 92 extending upwardly, the cushion assembly could be mounted in a different orientation if desired. Thus, the cushion assembly 28 could be mounted in a press with the piston rod 92 horizontal or extending downwardly.

In one specific embodiment of the invention, the cushion assembly 28 was constructed for use in a press 10 which operates at a rate of 300 cycles per minute. Thus, in this specific example, the piston 38 is moved downwardly through a cushioning stroke from the extended position shown in FIG. 1 to the retracted position shown in FIG. 2 against the fluid pressure in the manifold chamber 32 300 times every minute. Of course, the piston 38 is also moved upwardly through a return stroke from the position shown in FIG. 2 back to the position shown in FIG. 1 by the fluid pressure in the manifold chamber 300 times every minute. The length of a cushioning stroke and the length of a return stroke in this particular press is 0.25 inches.

In this specific embodiment of the invention, the diaphragm 52 has the previously described construction with a dacron fabric forming the outer side surface 62 of the diaphragm and a layer of nitrile forming the inner side 64 of the diaphragm. The diaphragm has an outside diameter of approximately 1.74 inches. The fluid pressure in the manifold chamber 32 was maintained at approximately 1,500 psi.

The projected life expectancy of the cushion assembly 28 in a press operated in the foregoing manner, that is at a rate of 300 cycles per minute and with a cushion assembly stroke of 0.25 inches, is 100,000,000 cycles. If the press is continuously operated at this rate for twenty-four hours per day, the cushion assembly 28 would have a projected operating life of approximately 230 days. , A known cushion assembly does not have the construction of the cushion assembly 28. Thus, this known cushion assembly does not utilize a diaphragm 52 to retain a body 54 of lubricant in engagement with a piston 38 during operation of the press. This known cushion assembly is used in a press having a stroke of 0.25 inches and operated at a rate of only 100 cycles per minute. This known cushion assembly has a projected operating life of approximately 1,000,000 cycles. Therefore, this known cushion assembly will last for approximately seven days if the press is operated at the rate of 100 cycles per minute for twenty-four hours per day.

The previously described example of a cushion assembly 28 constructed in accordance with the present invention and having an operating stroke of 0.25 inches and operated at a rate of 300 cycles per minute has a projected operating life which is more than thirty times longer than a known cushion assembly with the same cushioning and return stroke lengths and operated at a rate of only 100 cycles per minute. Although it can only be theorized why the cushion assembly 28 constructed in accordance with the present invention has a projected operating life which is so much greater than the projected operating life of the known cushion assembly, it is believed that the cushion assembly 28 of the present invention has its relatively long operating life due to the ability of the body 54 of lubricant to maintain the seals 46 in a lubricated condition during operation of the cushion assembly. It is believed that the relatively short operating stroke, specifically 0.25 inches, results in the seals of the known cushion assembly running dry and wearing out with a relatively short operating life.

In view of the foregoing description, it is apparent that the present invention relates to a new and improved apparatus and method for use in cushioning movement of a member in a press 10 during operation of the press between open and closed conditions. Although the apparatus and method may advantageously be used on many different types of presses, it is believed that the apparatus and method will be particularly useful when used in association with a cushion assembly 28 having a piston 38 and cylinder 36 which is operated through relatively short strokes a relatively high speed. Thus, it is believed that the apparatus and method of the present invention will be particularly advantageous when used in association with a press cushion assembly 28 which is operated at a rate of at least 100 cycles per minute through cushioning and return strokes of 0.50 inches or less during each operating cycle. This is because the present invention maintains seals 46 in the cushion assembly 28 lubricated during operation of the press 10. Of course, the apparatus and method of the present invention may also be used to lubricate the seals in cushion assemblies which are operated at slower speeds through longer strokes.

The apparatus and method of the present invention retains a body 54 of lubricant between an inner side 64 of a diaphragm 52 and a piston 38 in a cushion assembly 28 used to cushion movement of a member in a press 10. Fluid pressure is applied against an outer side 62 of the diaphragm 52 and is transmitted to the piston 38 in the cushion assembly 28.

During operation of the press 10 from an open condition (FIG. 1) to a closed condition (FIG. 2), the piston 38 is moved against the influence of the fluid pressure 66 applied against the diaphragm 52 to cushion movement of a member in the press. During operation of the press 10 from the closed condition to the open condition, the fluid pressure 66 applied against the diaphragm 52 moves the piston 38 back to its initial position relative to the cylinder 36. During this movement of the piston 38, seals 46 between the piston and cylinder 36 are continuously lubricated by lubricant from the body 43 of lubricant disposed between the piston and diaphragm.

During operation of the press 10 between the open and closed conditions, the diaphragm 52 is advantageously maintained in a spaced apart relationship with the piston 38. The space between the diaphragm 52 and piston 38 is filled by the body 54 of lubricant. Therefore, the fluid pressure 66 applied against the outer side 62 of the diaphragm 52 is transmitted through the body 54 of lubricant to the piston 38. By maintaining the spaced apart relationship between the diaphragm 52 and piston 38, diaphragm wear tends to be minimized and the operating life of the cushion assembly 28 tends to be maximized.

Having described the invention, the following is claimed:

1. An apparatus for use in cushioning movement of a member in a press during operation of the press between open and closed conditions, said apparatus comprising a cylinder, a piston disposed in and movable relative to said cylinder, said piston having a head end and a rod end and cooperating with said cylinder to at least partially define head and rod end variable volume chambers adjacent opposite ends of said piston, seal means disposed between said piston and cylinder for blocking fluid flow between said head and rod end variable volume chambers, a piston rod extending from said rod end of said piston through the rod end variable volume chamber and one end portion of said cylinder, said piston rod being movable under the influence of force transmitted from the member to move said piston relative to said cylinder in a direction to increase the size of the rod end variable volume chamber during operation of the press from the open condition to the closed condition, flexible diaphragm means extending across an end portion of said cylinder opposite from the one end portion for retaining a body of lubricant between an inner side of said flexible diaphragm means and the head end of said piston to lubricate said seal means during movement of said piston relative to said cylinder and operation of the press between the open and closed conditions, means for applying fluid pressure against an outer side of said flexible diaphragm means opposite from the inner side of said flexible diaphragm means to oppose movement of said piston under the influence of force transmitted from the member to said piston by said piston rod during operation of the press from the open condition to the closed condition, said piston being movable relative to said cylinder in a direction to decrease the size of the rod end variable volume chamber under the influence of fluid pressure applied against the outer side of said flexible diaphragm means and transmitted to said piston during operation of the press from the closed condition to the open condition, said cylinder having an outer side and an inner side which cooperates with said piston to at least partially define the head and rod end variable volume chambers, and connector means extending around the outer side of said cylinder to connect a circular outer portion of said flexible diaphragm means with said cylinder, said flexible diaphragm means including a circular inner portion which is disposed in said cylinder when the press is in the open condition.

2. An apparatus as set forth in claim 1 wherein said flexible diaphragm means further includes an annular roll portion which extends across the end portion of said cylinder opposite from said one end portion and which is connected with said inner and outer portions of said flexible diaphragm means.

3. An apparatus as set forth in claim 1 wherein said piston is movable relative to said cylinder in the direction to increase the size of the rod end variable volume chamber through an operating stroke of 0.050 inches or less against the influence of fluid pressure applied against the outer side of said flexible diaphragm means and transmitted to said piston during operation of the press from the open condition to the closed condition, said piston being movable relative to said cylinder in the direction to decrease the size of the rod end variable volume chamber through a return stroke of 0.50 inches or less under the influence of fluid pressure applied against the outer side of said flexible diaphragm means and transmitted to said piston during operation of the press from the closed condition to the open condition.

4. An apparatus as set forth in claim 3 wherein said piston is moved through operating and return strokes at a rate of at least 100 operating and 100 return strokes per minute during operation of the press.

5. An apparatus for use in cushioning movement of a member in a press during operation of the press between open and closed conditions, said apparatus comprising a cylinder, a piston disposed in and movable relative to said cylinder, said piston having a head end and a rod end and cooperating with said cylinder to at least partially define head and rod end variable volume chambers adjacent opposite ends of said piston, seal means disposed between said piston and cylinder for blocking fluid flow between said head and rod end variable volume chambers, a piston rod extending from said rod end of said piston through the rod end variable volume chamber and one end portion of said cylinder, said piston rod being movable under the influence of force transmitted from the member to move said piston relative to said cylinder in a direction to increase the size of the rod end variable volume chamber during operation of the press from the open condition to the closed condition, flexible diaphragm means extending across an end portion of said cylinder opposite from the one end portion for retaining a body of lubricant between an inner side of said flexible diaphragm means and the head end of said piston to lubricate said seal means during movement of said piston relative to said cylinder and operation of the press between the open and closed conditions, and means for applying fluid pressure against an outer side of said flexible diaphragm means opposite from the inner side of said flexible diaphragm means to oppose movement of said piston under the influence of force transmitted from the member to said piston by said piston rod during operation of the press from the open condition to the closed condition, said piston being movable relative to said cylinder in a direction to decrease the size of the rod end variable volume chamber under the influence of fluid pressure applied against the outer side of said flexible diaphragm means and transmitted to said piston during operation of the press from the closed condition to the open condition, the rod end variable volume chamber is relatively small and said flexible diaphragm means is at least partially disposed within said cylinder when the press is in the open condition, the rod end variable volume chamber being relatively large and said flexible diaphragm means being at least partially disposed outside of said cylinder when the press is in the closed condition.

6. An apparatus as set forth in claim 5 wherein the inner side of said flexible diaphragm means is spaced from said piston and the body of lubricant fills the space between the inner side of said flexible diaphragm means and said piston, said piston being movable relative to said cylinder to decrease the size of the rod end variable volume chamber under the influence of pressure transmitted from said flexible diaphragm means through the body of lubricant to said piston.

7. An apparatus as set forth in claim 5 wherein said piston is movable relative to said cylinder in the direction to increase the size of the rod end variable volume chamber through an operating stroke of 0.50 inches or less against the influence of fluid pressure applied against the outer side of said flexible diaphragm means and transmitted to said piston during operation of the press from the open condition to the closed condition, said piston being movable relative to said cylinder in the direction to decrease the size of the rod end variable volume chamber through a return stroke of 0.50 inches or less under the influence of fluid pressure applied against the outer side of said flexible diaphragm means and transmitted to said piston during operation of the press from the closed condition to the open condition.

8. An apparatus as set forth in claim 7 wherein said piston is moved through operating and return strokes at a rate of at least 100 operating and 100 return strokes per minute during operation of the press.

9. An apparatus for use in cushioning movement of a member in a press during operation of the press between open and closed conditions, said apparatus comprising a cylinder, a piston disposed in and movable relative to said cylinder, said piston having a head end and a rod end and cooperating with said cylinder to at least partially define head and rod end variable volume chambers adjacent opposite ends of said piston, seal means disposed between said piston and cylinder for blocking fluid flow between said head and rod end variable volume chambers, a piston rod extending from said rod end of said piston through the rod end variable volume chamber and one end portion of said cylinder, said piston rod being movable under the influence of force transmitted from the member to move said piston relative to said cylinder in a direction to increase the size of the rod end variable volume chamber during operation of the press from the open condition to the closed condition, flexible diaphragm means extending across an end portion of said cylinder opposite from the one end portion for retaining a body of lubricant between an inner side of said flexible diaphragm means and the head end of said piston to lubricate said seal means during movement of said piston relative to said cylinder and operation of the press between the open and closed conditions, and means for applying fluid pressure against an outer side of said flexible diaphragm means opposite from the inner side of said flexible diaphragm means to oppose movement of said piston under the influence of force transmitted from the member to said piston by said piston rod during operation of the press from the open condition to the closed condition, said piston being movable relative to said cylinder in a direction to decrease the size of the rod end variable volume chamber under the influence of fluid pressure applied against the outer side of said flexible diaphragm means and transmitted to said piston during operation of the press from the closed condition to the open condition, said flexible diaphragm means includes a circular central portion which is disposed within said cylinder when the press is in the open condition, a cylindrical inner wall portion which is of variable axial length and which is disposed in said cylinder adjacent to a cylindrical inner side surface of said cylinder when said press is in the open condition, a cylindrical outer wall portion which is of a variable axial length and which is disposed outside of said cylinder, and an annular roll portion which interconnects said cylindrical inner and outer wall portions of said flexible diaphragm means and which has an arcuate cross sectional configuration in a radial plane, said annular roll portion having a radially inner portion which is connected with one end of said cylindrical inner wall portion of said flexible diaphragm means and a radially outer portion which is connected with one end of said cylindrical outer wall portion of said flexible diaphragm means, said annular roll portion of said flexible diaphragm means being axially movable relative to said cylinder during operation of said press from the open condition to the closed condition in a direction to decrease the axial extent of said cylindrical inner wall portion and to increase the axial extent of said cylindrical outer wall portion, said annular roll portion of said flexible diaphragm means being axially movable relative to said cylinder during operation of said press from the closed condition to the open condition in a direction to increase the axial extent of said cylindrical inner wall portion and to decrease the axial extent of said cylindrical outer wall portion.

10. An apparatus as set forth in claim 9 further including connector means for connecting said cylindrical outer wall portion of said flexible diaphragm means with the outer side of said cylinder, said connector means having an annular configuration and extending around the outside of said cylinder.

11. An apparatus as set forth in claim 9 wherein said circular central portion of said flexible diaphragm means is spaced apart from said piston with the body of lubricant at least partially disposed between said circular central portion of said flexible diaphragm means and said piston.

12. An apparatus as set forth in claim 11 wherein said annular roll portion of said flexible diaphragm means is filled by the body of lubricant when the press is in the open condition, said cylinder extending into said annular roll portion of said flexible diaphragm means when the press is in the closed condition.

13. A method of cushioning movement of a member in a press during operation of the press between open and closed conditions, said method comprising the steps of retaining a body of lubricant between an inner side of a diaphragm and a piston, urging the piston to a first end-of-stroke position relative to a cylinder by applying fluid pressure against an outer side of the diaphragm and transmitting the pressure from the diaphragm to the piston when the press is in the open condition, moving the piston relative to the cylinder from the first end-of-stroke position to a second end-of-stroke position under the influence of force transmitted to the piston from the member during operation of the press from the open condition to the closed condition, said step of moving the piston to the second end-of-stroke position during operation of the press from the open condition to the closed condition including moving the piston against the influence of the fluid pressure applied against the outer side of the diaphragm and transmitted to the piston, moving the piston from the second end-of-stroke position to the first end-of-stroke position under the influence of the fluid pressure applied against the outer side of the diaphragm and transmitted to the piston during operation of the press from the closed condition to the open condition, and lubricating a seal between the piston and cylinder with lubricant from the body of lubricant during operation of the press between the open and closed conditions and movement of the piston relative to the cylinder, said step of moving the piston from the first end-of-stroke position to the second end-of-stroke position during operation of the press from the open condition to the closed condition includes moving the diaphragm relative to the cylinder from a first position in which the diaphragm extends a first distance into the cylinder to a second position in which the extent to which the diaphragm extends into the cylinder is less than the first distance.

14. A method as set forth in claim 13 wherein said step of moving the piston from the first end-of-stroke position to the second end-of-stroke position during operation of the press from the open condition to the closed condition includes moving the piston relative to the cylinder through a distance of 0.50 inches or less and said step of moving the piston from the second end-of-stroke position to the first end-of-stroke position during operation of the press from the closed condition to the open condition includes moving the piston relative to the cylinder through a distance of 0.50 inches or less.

15. A method as set forth in claim 13 wherein said steps of moving the piston from the first end-of-stroke position to the second end-of-stroke position and moving the piston from the second end-of-stroke position to first end-of-stroke position are repeated at a rate of at least 100 times per minute.

16. A method as set forth in claim 13 wherein said step of moving the piston from the first end-of-stroke position to the second end-of-stroke position during operation of the press from the open condition to the closed condition includes moving the body of lubricant and the diaphragm in a first direction relative to the cylinder under the influence of the force transmitted to the piston from the member, said step of moving the piston from the second end-of-stroke position to the first end-of-stroke position during operation of the press from the closed condition to the open condition includes moving the body of lubricant and diaphragm in a second direction relative to the cylinder under the influence of the fluid pressure applied against the outer side of the diaphragm.

17. A method as set forth in claim 13 further including the step of maintaining the diaphragm in a spaced apart relationship with the piston by maintaining at least a portion of the body of lubricant between the piston and the diaphragm during movement of the piston between the first and second end-of-stroke positions.

18. A method as set forth in claim 17 wherein said step of moving the piston from the second end-of-stroke position to the first end-of-stroke position during operation of the press from the closed condition to the open condition includes transmitting force from the inner side of the diaphragm to the piston through the portion of the body of lubricant disposed between the diaphragm and piston.

19. A method as set forth in claim 13 further including the step of maintaining a substantially constant fluid pressure against the outer side of the diaphragm during movement of the piston from the first end-of-stroke position to the second end-of-stroke position and during movement of the piston from the second end-of-stroke position t the first end-of-stroke position.

20. A method as set forth in claim 13 wherein the body of lubricant is a liquid, said method further including the step of maintaining the fluid pressure in the body of lubricant substantially constant during movement of the piston from the first end-of-stroke position to the second end-of-stroke position and during movement of the piston from the second end-of-stroke position to the first end-of-stroke position.

21. An apparatus for use in cushioning movement of a member in a press during operation of the press at a rate of at least 100 cycles per minute to sequentially form workpieces, said apparatus comprising a cushion assembly operable through cushioning and return strokes during each cycle of operation of the press, said cushion assembly including a cylinder and a piston disposed in said cylinder, said piston being movable in a first direction relative to said cylinder through a cushioning stroke of 0.50 inches or less under the influence of force transmitted from the member to the piston during each operating cycle of the press, said cushion assembly further including a flexible diaphragm connected with said cylinder to retain a body of lubricant in engagement with said piston during operation of said press, and means for applying fluid pressure against said diaphragm to pressurize the body of lubricant and to move said piston in a second direction relative to said cylinder through a return stroke of 0.50 inches or less during each operating cycle of the press, said diaphragm having a circular central portion which is disposed within said cylinder at the beginning of a cushioning stroke of said piston, a cylindrical inner wall portion which is of variable axial length and which is disposed in said cylinder adjacent to a cylindrical inner side surface of said cylinder at the beginning of a cushioning stroke of said piston, a cylindrical outer wall portion which is of a variable axial length and which is disposed outside of said cylinder, and an annular roll portion which interconnects said cylindrical inner and outer wall portions of said diaphragm and which has an arcuate cross sectional configuration in a radial plane, said annular roll portion having a radially inner portion which is connected with one end of said cylindrical inner wall portion of said diaphragm and a radially outer portion which is connected with one end of said cylindrical outer wall portion of said diaphragm, said annular roll portion of said diaphragm being axially movable relative to said cylinder in a direction to decrease the axial extent of said cylindrical inner wall portion and to increase the axial extent of said cylindrical outer wall portion during operation of said cushion assembly through a cushioning stroke, said annular roll portion of said diaphragm being axially movable relative to said cylinder in a direction to increase the axial extent of said cylindrical inner wall portion and to decrease the axial extent of said cylindrical outer wall portion during operation of said cushion assembly through a return stroke.

22. An apparatus as set forth in claim 21 wherein said piston and diaphragm are spaced apart from each other and the body of lubricant fills the space between said piston and diaphragm, said piston being movable through the return stroke under the influence of pressure transmitted through the body of lubricant to said piston during the return stroke of said piston.

23. An apparatus as set forth in claim 21 further including connector means for connecting said cylindrical outer wall portion of said diaphragm with the outer side of said cylinder, said connector means having an annular configuration and extending around the outside of said cylinder.

24. An apparatus as set forth in claim 21 wherein said circular central portion of said diaphragm is spaced apart from said piston with the body of lubricant at least partially disposed between said circular central portion of said diaphragm and said piston.

25. An apparatus as set forth in claim 24 wherein said annular roll portion of said diaphragm is filled by the body of lubricant at the beginning of a cushioning stroke of said piston, said cylinder extending into said annular roll portion of said diaphragm at the end of a cushioning stroke of said piston.

26. An apparatus for use in cushioning movement of a member in a press during operation of the press between open and closed conditions, said apparatus comprising a cylinder, a piston disposed in and movable relative to said cylinder, said piston having a head end and a rod end and cooperating with said cylinder to at least partially define head and rod end variable volume chambers adjacent opposite ends of said piston, seal means disposed between said piston and cylinder for blocking fluid flow between said head and rod end variable volume chambers, a piston rod extending from said rod end of said piston through the rod end variable volume chamber and one end portion of said cylinder, said piston rod being movable under the influence of force transmitted from the member to move said piston relative to said cylinder in a direction to increase the size of the rod end variable volume chamber during operation of the press from the open condition to the closed condition, a flexible diaphragm extending across an end portion of said cylinder opposite from the one end portion for retaining a body of lubricant between an inner side of said flexible diaphragm and the head end of said piston to lubricate said seal means during movement of said piston relative to said cylinder and operation of the press between the open and closed condition, and means for applying fluid pressure against an outer side of said flexible diaphragm opposite from the inner side of said flexible diaphragm to oppose movement of said piston under the influence of force transmitted from the member to said piston by said piston rod during operation of the press from the open condition to the closed condition, said piston being movable relative to said cylinder in a direction to decrease the size of the rod end variable volume chamber under the influence of fluid pressure applied against the outer side of said flexible diaphragm and transmitted to said piston during operation of the press from the closed condition to the open condition, said flexible diaphragm having a circular central portion which is axially aligned with said piston, a cylindrical radially inner wall portion which is of variable axial length, a cylindrical outer wall portion which is of a variable axial length and which is coaxial with said cylindrical inner wall portion, and an annular roll portion which interconnects said cylindrical inner and outer wall portions of said flexible diaphragm and which has an arcuate cross sectional configuration in a radial plane, said annular roll portion having a radially inner portion which is connected with one end of said cylindrical inner wall portion of said flexible diaphragm and a radially outer portion which is connected with one end of said cylindrical outer wall portion of said flexible diaphragm, said annular roll portion of said flexible diaphragm being axially movable relative to said cylinder during operation of said press from the open condition to the closed condition in a direction to decrease the axial extent of said cylindrical inner wall portion and to increase the axial extent of said cylindrical outer wall portion, said annular roll portion of said flexible diaphragm being axially movable relative to said cylinder during operation of said press from the closed condition to the open condition in a direction to increase the axial extent of said cylindrical inner wall portion and to decrease the axial extent of said cylindrical outer wall portion.

27. An apparatus as set forth in claim 26 wherein said cylinder has an outer side and an inner side which cooperates with said piston to at least partially define the head and rod end variable volume chambers, said apparatus further including connector means extending around the outer side of said cylinder to connect said cylindrical outer wall portion of said flexible diaphragm with said cylinder.

28. An apparatus as set forth in claim 26 wherein said piston is movable relative to said cylinder in the direction to increase the size of the rod end variable volume chamber through an operating stroke of 0.50 inches or less against the influence of fluid pressure applied against the outer side of said flexible diaphragm and transmitted to said piston during operation of the press from the open condition to the closed condition, said piston being movable relative to said cylinder in the direction to decrease the size of the rod end variable volume chamber through a return stroke of 0.50 inches or less under the influence of fluid pressure applied against the outer side of said flexible diaphragm and transmitted to said piston during operation of the press from the closed condition to the open condition.

29. An apparatus as set forth in claim 28 wherein said piston is moved through operating and return strokes at a rate of at least 100 operating and 100 return strokes per minute during operation of the press.

30. An apparatus as set forth in claim 26 wherein the rod end variable volume chamber is relatively small and said flexible diaphragm is at least partially disposed within said cylinder when the press is in the open condition, the rod end variable volume chamber being relatively large and said flexible diaphragm being at least partially disposed outside of said cylinder when the press is in the closed condition.

31. An apparatus as set forth in claim 26 wherein the inner side of said flexible diaphragm is spaced from said piston and the body of lubricant fills the space between the inner side of said flexible diaphragm and said piston, said piston being movable relative to said cylinder to decrease the size of the rod end variable volume chamber under the influence of pressure transmitted from said flexible diaphragm through the body of lubricant to said piston.

32. An apparatus as set forth in claim 31 further including connector means for connecting said cylindrical outer wall portion of said flexible diaphragm with the outer side of said cylinder, said connector means having an annular configuration and extending around the outside of said cylinder.

33. An apparatus as set forth in claim 26 wherein said annular roll portion of said flexible diaphragm is filled by the body of lubricant when the press is in the open condition, said cylinder extending into said annular roll portion of said flexible diaphragm when the press is in the closed condition.

34. An apparatus for use in cushioning movement of a member in a press during operation of the press between open and closed conditions, said apparatus comprising a cylinder, a piston disposed in and movable relative to said cylinder, said piston having a head end and a rod end and cooperating with said cylinder to at least partially define head and rod end variable volume chambers adjacent opposite ends of said piston, a piston rod extending from said rod end of said piston through the rod end variable volume chamber and one end portion of said cylinder, said piston rod being movable under the influence of force transmitted from the member to move said piston relative to said cylinder in a direction to increase the size of the rod end variable volume chamber during operation of the press from the open condition to the closed condition, a flexible diaphragm extending across an end portion of said cylinder opposite from the one end portion, and means for applying fluid pressure against an outer side of said flexible diaphragm to oppose movement of said piston under the influence of force transmitted from the member to said piston by said piston rod during operation of the press from the open condition to the closed condition, said piston being movable relative to said cylinder in a direction to decrease the size of the rod end variable volume chamber under the influence of fluid pressure applied against the outer side of said flexible diaphragm and transmitted to said piston during operation of the press from the closed condition to the open condition, said flexible diaphragm having a circular central portion, a cylindrical outer wall portion which is of a variable axial length, and an annular roll portion which connects said cylindrical outer wall portion of said flexible diaphragm with said circular central portion of said flexible diaphragm, said annular roll portion extending radially inwardly from said cylindrical outer wall portion and having an arcuate cross sectional configuration in a radial plane, said annular roll portion of said flexible diaphragm being axially movable relative to said cylinder during operation of said press from the open condition to the closed condition in a direction to increase the axial extent of said cylindrical outer wall portion, said annular roll portion of said flexible diaphragm being axially movable relative to said cylinder during operation of said press from the closed condition to the open condition in a direction to decrease the axial extent of said cylindrical outer wall portion.

35. An apparatus as set forth in claim 34 wherein said cylinder has an outer side and an inner side which cooperates with said piston to at least partially define the head and rod end variable volume chambers, said apparatus further including connector means extending around the outer side of said cylinder to connect said cylindrical outer wall portion of said flexible diaphragm with said cylinder.

36. An apparatus as set forth in claim 34 wherein said piston is movable relative to said cylinder in the direction to increase the size of the rod end variable volume chamber through an operating stroke of 0.50 inches or less against the influence of fluid pressure applied against the outer side of said flexible diaphragm and transmitted to said piston during operation of the press from the open condition to the closed condition, said piston being movable relative to said cylinder in the direction to decrease the size of the rod end variable volume chamber through a return stroke of 0.50 inches or less under the influence of fluid pressure applied against the outer side of said flexible diaphragm and transmitted to said piston during operation of the press from the closed condition to the open condition.

37. An apparatus as set forth in claim 34 wherein said piston is moved through operating and return strokes at a rate of at least 100 operating and 100 return strokes per minute during operation of the press.

38. An apparatus as set forth in claim 34 wherein the rod end variable volume chamber is relatively small and said flexible diaphragm is at least partially disposed within said cylinder when the press is in the open condition, the rod end variable volume chamber being relatively large and said flexible diaphragm being at least partially disposed outside of said cylinder when the press is in the closed condition.

39. An apparatus as set forth in claim 34 wherein an inner side of said flexible diaphragm is spaced from said piston and a body of lubricant fills the space between the inner side of said flexible diaphragm and said piston, said piston being movable relative to said cylinder to decrease the size of the rod end variable volume chamber under the influence of pressure transmitted from said flexible diaphragm through the body of lubricant to said piston.

40. An apparatus as set forth in claim 34 further including connector means for connecting said cylindrical outer wall portion of said flexible diaphragm with the outer side of said cylinder, said connector means having an annular configuration and extending around the outside of said cylinder.

41. An apparatus as set forth in claim 34 wherein said cylinder extends into said annular roll portion of said flexible diaphragm when the press is in the closed condition.

42. A method of cushioning movement of a member in a press during operation of the press between open and closed conditions, said method comprising the steps of urging a piston to a first position relative to a cylinder by applying fluid pressure against an outer side of a flexible diaphragm and transmitting force from the flexible diaphragm to the piston when the press is in the open condition, moving the piston relative to the cylinder from the first position to a second position under the influence of force transmitted to the piston from the member during operation of the press from the open condition to the closed condition, said step of moving the piston to the second position during operation of the press from the open condition to the closed condition including moving the piston against the influence of the fluid pressure applied against the outer side of the flexible diaphragm and transmitted to the piston, moving an annular bend along material forming the flexible diaphragm in a first direction during movement of the piston from the first position to the second position, moving the piston from the second position to the first position under the influence of the fluid pressure applied against the outer side of the diaphragm and transmitted to the piston during operation of the press from the closed condition to the open condition, and moving the annular bend along the material forming the flexible diaphragm in a second direction during movement of the piston from the second position to the first position, the annular bend being disposed in a first portion of the material of the flexible diaphragm when the piston is in the first position, the annular bend being disposed in a second portion of the material of the flexible diaphragm when the piston is in the second position, the first portion of the material of the flexible diaphragm being at least partially offset from the second portion of the material of the flexible diaphragm.

43. A method as set forth in claim 42 further including the steps of retaining a body of lubricant between an inner side of the flexible diaphragm and the piston, said step of transmitting force from the flexible diaphragm to the piston including transmitting force through the body of lubricant to the piston.

44. A method as set forth in claim 43 further including the step of lubricating a seal between the piston and cylinder with lubricant from the body of lubricant during operation of the press between the open and closed conditions and movement of the piston relative to the cylinder.

45. A method as set forth in claim 42 wherein said step of moving the piston from the first position to the second position during operation of the press from the open condition to the closed condition includes moving the piston relative to the cylinder through a distance of 0.50 inches or less and said step of moving the piston from the second position to the first position during operation of the press from the closed condition to the open condition includes moving the piston relative to the cylinder through a distance of 0.50 inches or less.

46. A method as set forth in claim 45 wherein said steps of moving the piston from the first position to the second position and moving the piston from the second position to first position are repeated at a rate of at least 100 times per minute.

47. A method as set forth in claim 42 wherein said step of moving the piston from the first position to the second position during operation of the press from the open condition to the closed condition includes moving a body of lubricant and the flexible diaphragm in the first direction relative to the cylinder under the influence of the force transmitted to the piston from the member, said step of moving the piston from the second position to the first position during operation of the press from the closed condition to the open condition includes moving the body of lubricant and flexible diaphragm in a second direction relative to the cylinder under the influence of the fluid pressure applied against the outer side of the flexible diaphragm.

48. A method as set forth in claim 42 further including the step of maintaining the flexible diaphragm in a spaced apart relationship with the piston during movement of the piston between the first and second positions.

49. A method as set forth in claim 48 wherein said step of moving the piston from the second position to the first position during operation of the press from the closed condition to the open condition includes transmitting force from the inner side of the diaphragm to the piston through a portion of a body of lubricant disposed between the flexible diaphragm and piston.

50. A method as set forth in claim 48 further including the step of maintaining a substantially constant fluid pressure against the outer side of the flexible diaphragm during movement of the piston from the first position to the second position and during movement of the piston from the second position to the first position.

51. A method as set forth in claim 42 wherein said step of moving the piston from the first position to the second position during operation of the press from the open condition to the closed condition includes moving the flexible diaphragm relative to the cylinder from a first position in which the flexible diaphragm extends a first distance into the cylinder to a second position in which the extent to which the flexible diaphragm extends into the cylinder is less than the first distance.

* * * * *